United States Patent [19]

Hifumi

[11] Patent Number: 4,977,980

[45] Date of Patent: Dec. 18, 1990

[54] INDIRECT-PLUNGER HYDRAULIC ELEVATOR

[75] Inventor: Fujita Hifumi, Tokyo, Japan

[73] Assignee: Kabushiki Kaisha Toshiba, Kanagawa, Japan

[21] Appl. No.: 193,655

[22] Filed: May 13, 1988

[30] Foreign Application Priority Data

May 14, 1987 [JP] Japan ..... 62-72167[U]

[51] Int. Cl.[5] ..... B66B 7/08

[52] U.S. Cl. ..... 187/1 R; 187/20

[58] Field of Search ..... 187/89, 92, 80, 20, 187/17, 1 R; 414/630

[56] References Cited

U.S. PATENT DOCUMENTS

| | | | |
|---|---|---|---|
| 185,276 | 12/1876 | Andrews | 187/89 X |
| 418,878 | 1/1890 | Smith | 187/80 X |
| 657,380 | 9/1900 | Baldwin | 187/20 |
| 722,737 | 3/1903 | Meech | 187/92 X |
| 855,074 | 5/1907 | Suplee | 187/20 X |
| 1,721,603 | 7/1929 | Neenan | 187/20 |
| 1,873,829 | 8/1932 | Dunlop | 187/89 |
| 1,936,780 | 11/1933 | Arnold et al. | 187/80 |
| 2,001,361 | 5/1935 | Hymans | 187/80 |
| 2,319,126 | 5/1943 | Grote | 187/17 |
| 2,402,285 | 6/1946 | Hymans | 187/89 X |
| 3,101,130 | 8/1963 | Bianca | 187/20 |
| 3,252,547 | 5/1966 | Hornedo | 187/17 |
| 3,651,893 | 3/1972 | Berkovitz | 187/20 X |
| 4,699,251 | 10/1987 | Orndorff et al. | 187/1 R |

*Primary Examiner*—Andres Kashnikow
*Assistant Examiner*—Kenneth DeRosa
*Attorney, Agent, or Firm*—Banner, Birch, McKie & Beckett

[57] ABSTRACT

The present invention is an indirect-plunger hydraulic elevator having a car frame. The car frame has short-sized bracing members fixed respectively to the lower ends of vertical frames and a car platform supporting frame fixed separately on the bracing members. Furthermore, the elevator has a supporting beam fixed directly on the lower surface of the car platform supporting frame so as not to interfere with the safety devices and a couple of sheaves attached rotatably at both ends of the sheave supporting beam. The height between the car platform to the lowest ends of the sheaves becomes smaller than with the conventional elevators.

3 Claims, 5 Drawing Sheets

INDIRECT-PLUNGER HYDRAULIC ELEVATOR

BACKGROUND OF THE INVENTION

1. Field of the Invention

This invention relates to an indirect-plunger hydraulic elevator, in particular to an indirect-plunger hydraulic elevator that is moved up and down through a wire rope driven by a hydraulic jack.

2. Description of the Related Art

A conventional indirect-plunger hydraulic elevator is shown in FIGS. 7 through 10. In FIG. 7, symbol 1 shows an elevator car comprising a box-type car enclosure 2 and a car frame 3 supporting the car enclosure 2. The car frame 3 comprises a top beam (crosshead) 4, a couple of vertical frames (slings) 5 hanging downwardly on the right-hand side end and the left-side end respectively of the top beam 4, a bottom beam 6 fixed between each lower end of the vertical frames 5, and a car platform supporting frame 7 fixed on the bottom beam 6. On the car platform supporting frame 7, the car enclosure 2 is set through a vibration-preventing rubber 8.

As shown in FIGS. 8 and 9, the bottom beam 6 of the car frame 3 consists of a couple of long-sized channel-shaped frames enclosing the lower end portions of the vertical frames 5. On the lower side of the bottom beam 6, a safety device 9 is attached. In case of emergency, the safety devices 9 contact with guide rails 10 which are set to the right hand side and the left hand side of the bottom beam, respectively, to stop the car immediately.

Furthermore, on the lower side of the bottom beam 6 is a sheave supporting beam 11. This sheave supporting beam 11 consists of a couple of channel-shaped frames and is fixed to the lower side of the bottom beam by welding, bolts or the like. At both ends of the sheave supporting beam 11, sheaves 12 are rotatably attached. The sheave supporting beam 11 is fixed diagonally in an adequate angle against the bottom beam 6 and it crosses the bottom beam 6 so as not to interfere with the safety devices 9 and guide rails 10 set at the right hand side and the left hand side of the bottom beam respectively.

On the right and left sheaves 12 attached at the lower portion of the car 1, an up and down driving wire rope 13 is winded or disposed and one end portion thereof is fixed to a beam 14 located at the upper end of a hoistway. Another end portion of the up and down driving wire rope 13 is connected to a jack stand 18 through sheaves 17 attached to an upper end portion of a plunger 16 of a hydraulic jack 15 set inside the hoistway. Therefore, this conventional indirect-plunger hydraulic elevator has 2 to 4 roping. The plunger 16 of the hydraulic jack 15 moves up and down so that the elevator car 1 moves up and down through the wire rope 13 at double the speed of the plunger 16.

The above mentioned conventional indirect-plunger hydraulic elevator has the bottom beam 6, which supports the car platform supporting frame 7 and the safety device 9, on the lower side of the car frame 3 of the elevator car 1. The hydraulic elevator also has the sheave supporting beam 11, which supports a pair of sheaves 12, on the lower side of the bottom beam 6. Those beams 6 and 11 are both similar long-sided channel-shaped beams and are set together one on top of the other as a double stage structure. Therefore, the structure of the lower side of the car platform becomes complex so that the construction of those beams 6 and 11 and the elevator car necessarily gains weight. Furthermore, because of setting the sheave supporting beam 11 and the bottom beam 6 one on top of the other the height (H) between the bottom of the car enclosure 2 to the bottom end of the sheaves 12 becomes large so that it is necessary to dig a pit deeply at the bottom end of the hoistway.

SUMMARY OF THE INVENTION

An object of the present invention is to provide an indirect-plunger hydraulic elevator whose structure at the lower side of the car platform becomes relatively simpler and whose construction is relatively easy. Another object of the present invention is to provide a cost reduced indirect-plunger hydraulic elevator whose elevator car has less relative weight and whose pit at the bottom of the hoistway becomes relatively shallow because of the smaller size of the lower portion of the car platform.

According to the present invention, there is provided an indirect-plunger hydraulic elevator which includes a car enclosure. It also includes a car frame or the like, fixed on the outerside of the car enclosure, for supporting the car enclosure. This car frame has a top beam, a couple of vertical frames fixed to the right and left hand ends of the top beam, short-sized bracing members fixed respectively to the lower ends of the vertical frames, and a car platform supporting frame or the like fixed separately on the bracing members for supporting the car enclosure. Further included are safety devices connected to the bracing members, a sheave supporting beam fixed on the lower surface of the car platform supporting frame so as not to interfere with the safety devices, a couple of sheaves rotatably attached at both ends of the sheave supporting beam, a wire-like rope disposed along said sheaves, and a hydraulic jack or the like for moving the car enclosure up and down through the wire rope.

Further objects, features and other aspects of this invention will be better understood from the detailed description of certain embodiments of this invention with reference to the annexed drawings.

BRIEF DESCRIPTION OF THE DRAWINGS

FIG. 1 is a front view of an embodiment of the present invention;

FIG. 2 is a sectional view along the II—II line in FIG. 1;

FIG. 3 is a partial view along the III—III line in FIG. 2;

FIG. 4 is a partial view along the IV—IV line in FIG. 2;

FIG. 5 is an enlarged partial view of the portion A in FIG. 3; and

FIG. 6 is a partial view along the VI—VI line in FIG. 5.

FIG. 7 is a front view of the conventional hydraulic elevator;

FIG. 8 is a sectional view along the VIII—VIII in FIG. 7;

FIG. 9 is a partial view along the IX—IX line in FIG. 8; and

FIG. 10 is a partial view along the X—X line in FIG. 8.

DESCRIPTION OF THE PREFERRED EMBODIMENT

FIGS. 1 through 6 show an embodiment of the present invention.

Figure 1:
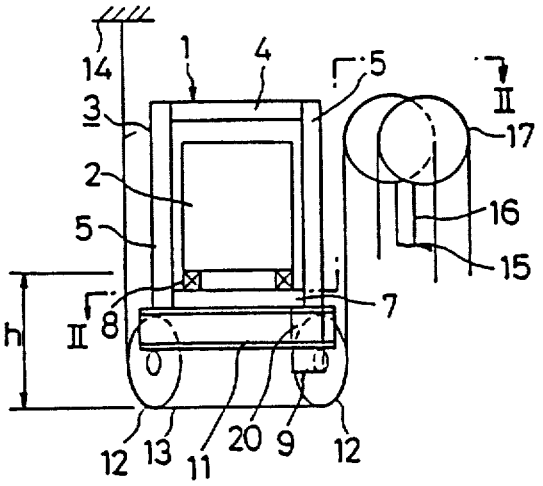
FIGS. 1 through 6 are views showing an embodiment of the present invention.
Figure 2:
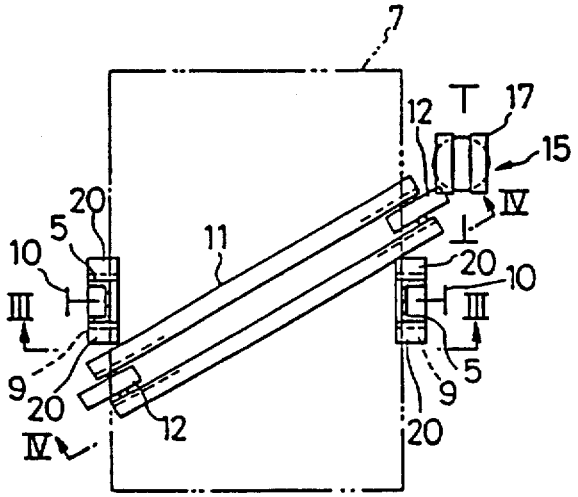

In FIGS. 1 and 2, an elevator car 1 comprises a car enclosure 2 and a car frame 3. The car frame 3 includes a top beam 4, a couple of vertical frames 5 hanging downwardly on the right-hand and the left-hand sides of the top beam respectively, short-sized bracing members 20 which are fixed respectively at the lower ends of the vertical frames 5, and a car platform supporting frame 7 which is fixed separately on the upper surfaces of the bracing members 20. The conventional long-sized channel-shaped frame 6 is omitted.

Figure 3:
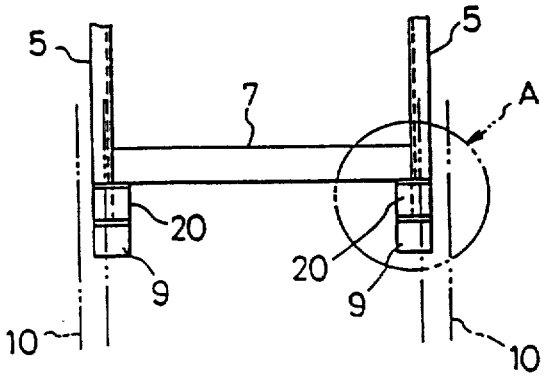
Figure 4:
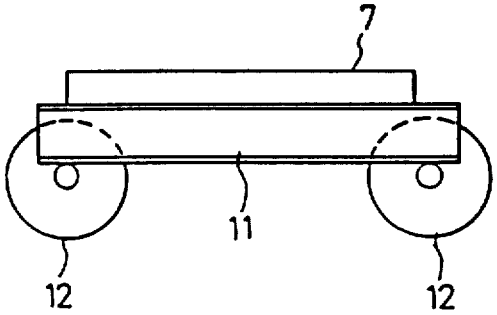
Figure 5:
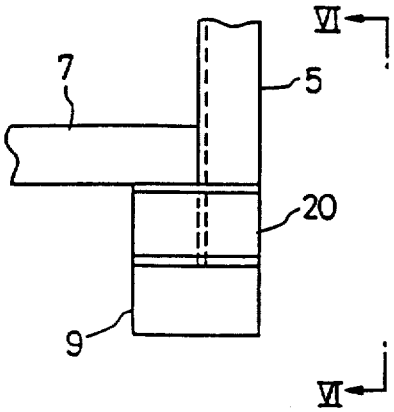
Figure 6:
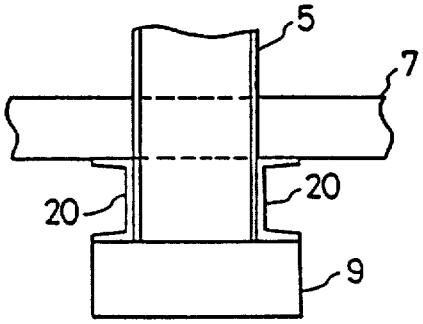
Figure 7:
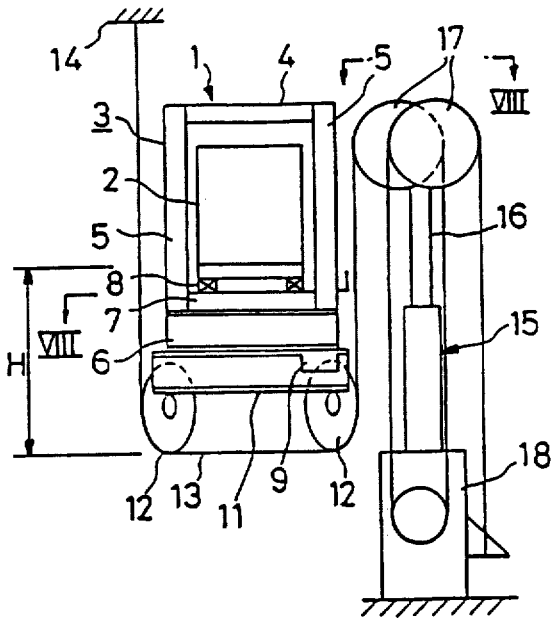
FIG. 7 (PRIOR ART)
FIGS. 7 through 10 are views showing a conventional hydraulic elevator.
Figure 8:
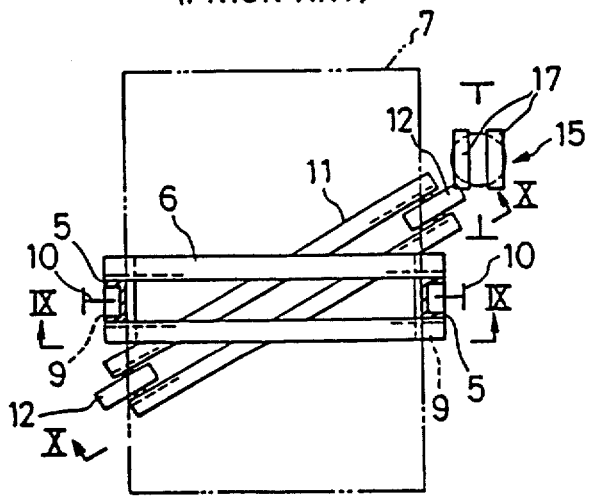
FIG. 8 (PRIOR ART)
Figure 9:
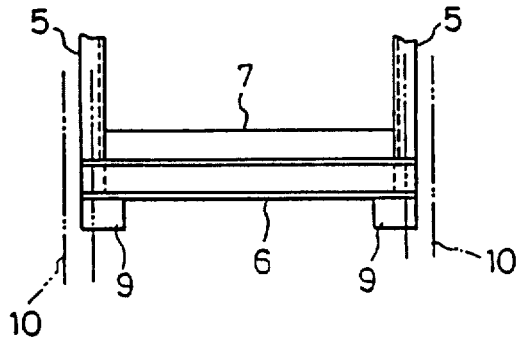
FIG. 9 (PRIOR ART)
Figure 10:
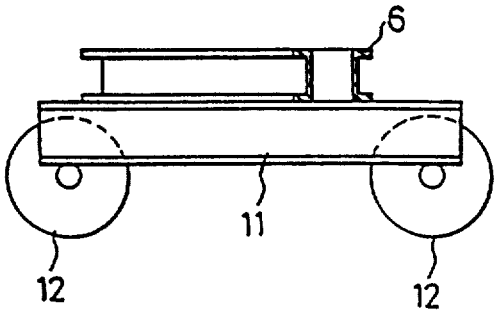
FIG. 10 (PRIOR ART)

The right and left bracing members 20, as shown in FIGS. 3, 5 and 6, each include a pair of short-sized channel-shaped beams which contact or enclose the lower end portions of the vertical frames 5. Attached to the lower portions of each of the bracing members 20 are safety devices 9 respectively. The car platform supporting frame 7 is fixed separately on the upper surfaces of the attachment vases 20 and is also fixed to the vertical frames 5. The car enclosure 2 is set on the car platform supporting frame 7 through a vibraton-preventing rubber 8. As shown in FIGS. 2 and 4, a sheave supporting beam 11 is fixed directly on the lower surface of the car platform supporting frame 7 by welding, bolts or the like. At both ends of the sheave supporting beam 11, the sheaves 12 are rotatably attached. Furthermore, the sheave supporting beam 11 is fixed diagonally in an adequate angle against the car platform supporting frame 7 so as not to interfere with the right and left side safety devices 9 and guide rails 10.

Along the sheaves 12, which are attached at both ends of the sheave supporting beam 11, an up and down driving wire rope 13 is disposed the same way as with the conventional indirect-plunger hydraulic elevator, described herein. The plunger 16 of the hydraulic jack 15 moves up and down so that the elevator car 1 moves up and down through the wire rope 13 at double the speed of the plunger 16 because of the 2 to 4 roping.

Therefore, in the indirect-plunger hydraulic elevator of the present invention, the short-sized bracing members 20 are fixed respectively at the lower ends of the each of each of the vertical frames 5. These vases support the safety devices 9 and the car platform supporting frame 7 which are fixed thereto. Moreover, the sheave supporting beam 11, with a couple of sheaves 12 rotatably attached, is fixed on the lower surface of the car platform supporting frame 7 so that the conventional long-sized frame 6 can be omitted and the prior art double stage structure of the beam members, like beams 6 and 11, can be avoided. Furthermore, the hydraulic elevator of the present invention has a simpler structure at the lower portion under the car platform and it has less relative weight. Also, the height (h) between the bottom of the car enclosure 2 to the lowest ends of the sheaves 12 is smaller than the conventional height (H) therebetween so that the pit at the bottom of the hoistway becomes relatively shallow.

Although a preferred embodiment of the invention has been described in considerable detail, those skilled in the art will appreciate that this is only one embodiment of the invention and that other variations and modifications may be made thereto all falling within the scope of the present invention as defined by the appended claims.

I claim:

1. An indirect-plunger hydraulic elevator comprising:
   - a car enclosure;
   - a car frame, fixed on the outerside of said car enclosure, for supporting said car enclosure including:
     - a top beam;
     - right and left vertical frames fixed to said top beam and having lower end portions;
     - a plurality of bracing members, each bracing member fixed to one of said lower end portion of said vertical frames; and
     - a car platform supporting frame, fixed to said bracing members, for supporting said car enclosure;
   - safety devices connected to said bracing members;
   - an elevator lifting sheave supporting beam fixed directly on a lower surface of said car platform supporting frame so as not to interfere with said bracing members and safety devices;
   - a pair of elevator lifting sheaves rotatably attached at both ends of said sheave supporting beam;
   - a wire rope disposed along said pair of elevator lifting sheaves; and
   - a hydraulic jack for moving said car enclosure up and down through said wire rope.

2. An elevator as in claim 1, wherein each of said plurality of bracing members further comprise a plurality of channel-shaped beams attached to each of said lower end portions of each of said plurality of vertical frames.

3. An elevator as in claim 1, wherein said platform supporting frame is also fixed to each of said plurality of vertical frames.

* * * * *

UNITED STATES PATENT AND TRADEMARK OFFICE

CERTIFICATE OF CORRECTION

PATENT NO. : 4,977,980

DATED : December 18, 1990

INVENTOR(S) : HIFUMI FUJITA

It is certified that error appears in the above-identified patent and that said Letters Patent is hereby corrected as shown below:

Col. 3, line 23, change "attachment vases" to --bracing members--;
line 25, change "vibraton" to --vibration--; and
line 46, change "vases" to --bracing members--.

Col. 4, claim 1, line 28, change "portion" to --portions--.

Col. 3, line 45, delete "the" (second occur.).
line 46, delete "each of" (first occur.).

Signed and Sealed this

Twenty-sixth Day of May, 1992

*Attest:*

*Attesting Officer*

DOUGLAS B. COMER

*Acting Commissioner of Patents and Trademarks*

UNITED STATES PATENT AND TRADEMARK OFFICE

CERTIFICATE OF CORRECTION

PATENT NO. : 4,977,980

DATED : December 18, 1990

INVENTOR(S) : Hifumi Fujita

It is certified that error appears in the above-identified patent and that said Letters Patent is hereby corrected as shown below:

On the title page, item (19), change "Hifumi" to --Fugita--

Item (75): Inventor:, change "Fujita Hifumi" to --Hifumi Fujita--.

Signed and Sealed this

Twenty-second Day of February, 1994

*Attest:*

Bruce Lehman

BRUCE LEHMAN

*Attesting Officer*

*Commissioner of Patents and Trademarks*